US010707597B2

(12) United States Patent
Bergner et al.

(10) Patent No.: US 10,707,597 B2
(45) Date of Patent: Jul. 7, 2020

(54) ELECTRICAL CONTACT DEVICE, ELECTRICAL CONNECTING UNIT AND METHOD FOR ASSEMBLING AN ELECTRICAL CABLE

(71) Applicant: TE Connectivity Germany GmbH, Bensheim (DE)

(72) Inventors: Bert Bergner, Bensheim (DE); Christian Mandel, Darmstadt (DE); Uwe Bluemmel, Hemsbach (DE); Rajesh Kumar, Frankfurt am Main (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/139,135

(22) Filed: Sep. 24, 2018

(65) Prior Publication Data

US 2019/0097330 A1 Mar. 28, 2019

(30) Foreign Application Priority Data

Sep. 22, 2017 (DE) ..... 10 2017 122 048

(51) Int. Cl.

| | |
|---|---|
| ***H01R 4/00*** | (2006.01) |
| ***H01R 11/28*** | (2006.01) |
| ***H01R 13/6592*** | (2011.01) |
| ***H01R 4/20*** | (2006.01) |
| ***H01R 9/03*** | (2006.01) |

(Continued)

(52) U.S. Cl.

CPC ..... *H01R 11/28* (2013.01); *H01R 4/18* (2013.01); *H01R 4/183* (2013.01); *H01R 4/20* (2013.01); *H01R 9/034* (2013.01); *H01R 13/6592* (2013.01); *H01R 43/048* (2013.01); *H01R 43/28* (2013.01); *H01R 24/40* (2013.01); *H01R 2105/00* (2013.01)

(58) Field of Classification Search

CPC . H01R 4/18; H01R 4/183; H01R 4/20; H01R 9/034; H01R 11/28; H01R 13/6592; H01R 43/048; H01R 43/28

USPC ... 174/74 R, 75 C, 78, 79, 84 R, 84 C, 88 C, 174/89, 93, 94 R

See application file for complete search history.

(56) References Cited

U.S. PATENT DOCUMENTS 1,687,574 A * 10/1928 Liss ..... B21D 53/36 192/125 B
2,762,117 A * 9/1956 Houck ..... B21D 39/037 16/2.1

(Continued)

FOREIGN PATENT DOCUMENTS

DE 69602096 T2 8/1999
JP 11025749 A 1/1999

(Continued)

OTHER PUBLICATIONS

German Office Action, dated Mar. 6, 2018, 10 pages.

(Continued)

*Primary Examiner* — William H. Mayo, III
(74) *Attorney, Agent, or Firm* — Barley Snyder

(57) ABSTRACT

An electrical contact device for a twin-axial electrical cable has a crimping section. In a crimped state on the twin-axial electrical cable, the crimping section is closed and has an oval cross-sectional shape in at least a portion of the crimping section.

16 Claims, 5 Drawing Sheets

(51) Int. Cl.

| | |
|---|---|
| ***H01R 4/18*** | (2006.01) |
| ***H01R 43/048*** | (2006.01) |
| ***H01R 43/28*** | (2006.01) |
| *H01R 105/00* | (2006.01) |
| *H01R 24/40* | (2011.01) |

(56) References Cited

U.S. PATENT DOCUMENTS

| | | | | |
|---|---|---|---|---|
| 4,415,223 | A * | 11/1983 | Asick | H01R 9/0518 174/89 |
| 4,596,440 | A * | 6/1986 | Quam | H01R 13/17 439/827 |
| 5,965,847 | A * | 10/1999 | Tanaka | H01R 9/0527 174/84 R |
| 5,994,646 | A | 11/1999 | Broeksteeg et al. | |
| 6,270,377 | B1 * | 8/2001 | Miyazaki | H01R 9/0527 439/607.41 |
| 6,380,485 | B1 * | 4/2002 | Beaman | H01R 9/035 174/88 R |
| 7,422,480 | B1 | 9/2008 | Musick et al. | |
| 8,991,045 | B2 | 3/2015 | Poma et al. | |
| 9,153,878 | B2 * | 10/2015 | Poma | H01R 4/184 |
| 9,917,407 | B1 * | 3/2018 | Mischke | H01R 24/20 |
| 2003/0073331 | A1 * | 4/2003 | Peloza | H01R 13/6473 439/108 |
| 2012/0031140 | A1 * | 2/2012 | Zhang | B60K 11/02 62/498 |
| 2014/0170897 | A1 * | 6/2014 | Nonen | H01R 13/5829 439/467 |
| 2014/0220798 | A1 * | 8/2014 | Putt, Jr. | H01R 13/652 439/95 |
| 2014/0220822 | A1 | 8/2014 | Keyser et al. | |
| 2016/0142030 | A1 * | 5/2016 | Hamner | H03H 7/0115 174/70 R |

FOREIGN PATENT DOCUMENTS

| | | | |
|---|---|---|---|
| JP | 2014225345 | A | 12/2014 |
| WO | 2015065584 | A1 | 5/2015 |

OTHER PUBLICATIONS

English translation of JP11025749, dated Feb. 8, 2018, 14 pages.
English translation of JP2014225345, dated Feb. 8, 2018, 10 pages.

* cited by examiner

ELECTRICAL CONTACT DEVICE, ELECTRICAL CONNECTING UNIT AND METHOD FOR ASSEMBLING AN ELECTRICAL CABLE

CROSS-REFERENCE TO RELATED APPLICATION

This application claims the benefit of the filing date under 35 U.S.C. § 119(a)-(d) of German Patent Application No. 102017122048.8, filed on Sep. 22, 2017.

FIELD OF THE INVENTION

The present invention relates to an electrical contact device and, more particularly, to an electrical contact device assembled with a twin-axial cable.

BACKGROUND

A large number of electrical connectors and counter-connectors are known that transmit electrical currents, voltages, signals and/or data with a large range of currents, voltages, frequencies and/or data rates. In the low, medium, or high voltage and/or current ranges, and especially in the motor vehicle industry, connectors must ensure permanently, repeatedly and/or, after a comparatively long service life, transmission of electrical power, signals and/or data without delay in warm, possibly hot, polluted, humid and/or chemically aggressive environments. Due to a wide range of applications, a large number of specially configured connectors are known.

Connectors or their housings can be installed at an electrical cable, a wire, a cable harness, or an electrical unit or device such as at/in a housing, at/on a leadframe, at/on a printed circuit board etc., of an electrical, electro-optical, or electronic component. A connector located at a cable, a wire, or a cable harness is known as a connector or a plug. A connector located at an electrical component is known as a counter-connector unit, often referred to as a receptacle or header.

Connectors must ensure perfect transmission of electrical signals and/or electrical power, wherein connectors corresponding with one another usually have fastening or locking arrangements for long-term but usually releasable fastening or locking of the connector at/in the counter-connector. Further, an electrical connecting unit having a contact device, such as a contact element, a ferrule, a terminal, or a shield contact sleeve, or a contact unit, must be received securely therein. In an assembled cable, such a connecting unit can be provided as a connector without a housing. Since the housings of the connectors are usually subject to a certain standardization, such as the FAKRA standard, the most important dimensions of the housings have the same dimensions across different manufacturers. Continuous efforts are being made to improve electrical contact devices, contact units, connecting units, connectors and assembled cables to make them smaller and more cost-effective.

Electromagnetically shielded twin-axial cables for high-speed differential signal transmission deviate from a circular cross-sectional geometry that is typical for cables and have an at least partially oval, for example elliptical, cross-sectional geometry. In this case, two electrical inner conductors of the twin-axial cable are surrounded by an electrical outer conductor such as a shielded film. Either the shield or an entire cross-sectional geometry of the twin-axial cable has an oval shape.

In order to obtain a small plug connection, an electromechanical interface of an electrical connecting unit for the twin-axial cable also has an oval cross-sectional geometry. A cross-sectional geometry of a crimping section of a cable has a circular cross-section in the prior art. Typical contact devices for crimping for twin-axial cables also have a circular cross-sectional geometry in a crimping section. A shield contact sleeve for a twin-axial cable which results therefrom, for example, requires a transition from oval, in an electrical contact section, to circular and optionally back to oval at an outer conductor crimping section. Such a transition is located at a critical point in a plug connector, where a comparatively narrow distance of the inner conductor of the twin-axial cable transitions into a wider division of the contact devices or contact units of the connector. Such a transition leads to a barely compensatable discontinuity in the impedance in the prior art, as shown in FIG. 12, which delimits a maximum usable frequency of such a plug connector, in particular in the full duplex mode of a related twin-axial cable.

SUMMARY

An electrical contact device for a twin-axial electrical cable comprises a crimping section. In a crimped state on the twin-axial electrical cable, the crimping section is closed and has an oval cross-sectional shape in at least a portion of the crimping section.

BRIEF DESCRIPTION OF THE DRAWINGS

The invention will now be described by way of example with reference to the accompanying Figures, of which.

DETAILED DESCRIPTION OF THE EMBODIMENTS

Figure 1:
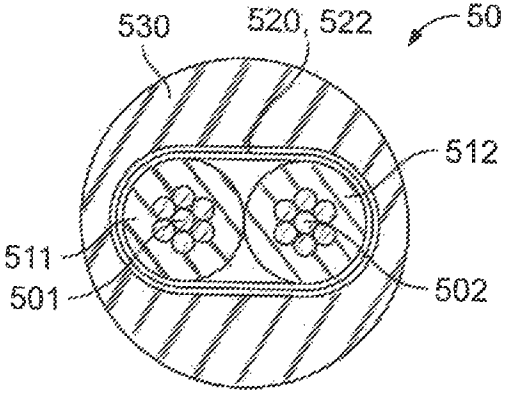
FIG. 1 is a sectional front view of a twin-axial cable according to an embodiment with a circular outer geometry and an oval inner geometry of an electromagnetic shield.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 10:
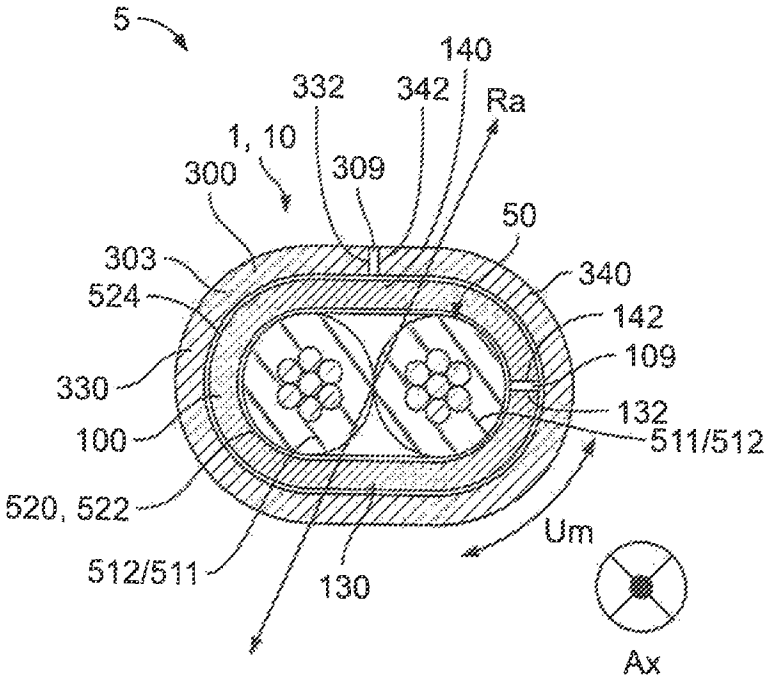
FIG. 10 is a sectional end view of the twin-axial cable assembled with the ferrule and the shield contact sleeve.
Figure 9:
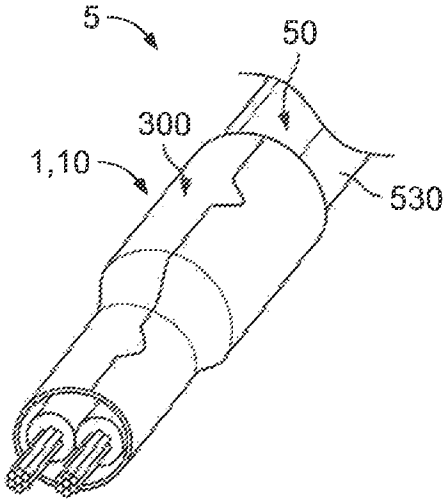
FIG. 9 is a perspective view of the twin-axial cable with the shield contact sleeve crimped on the free longitudinal end section.
Figure 11:
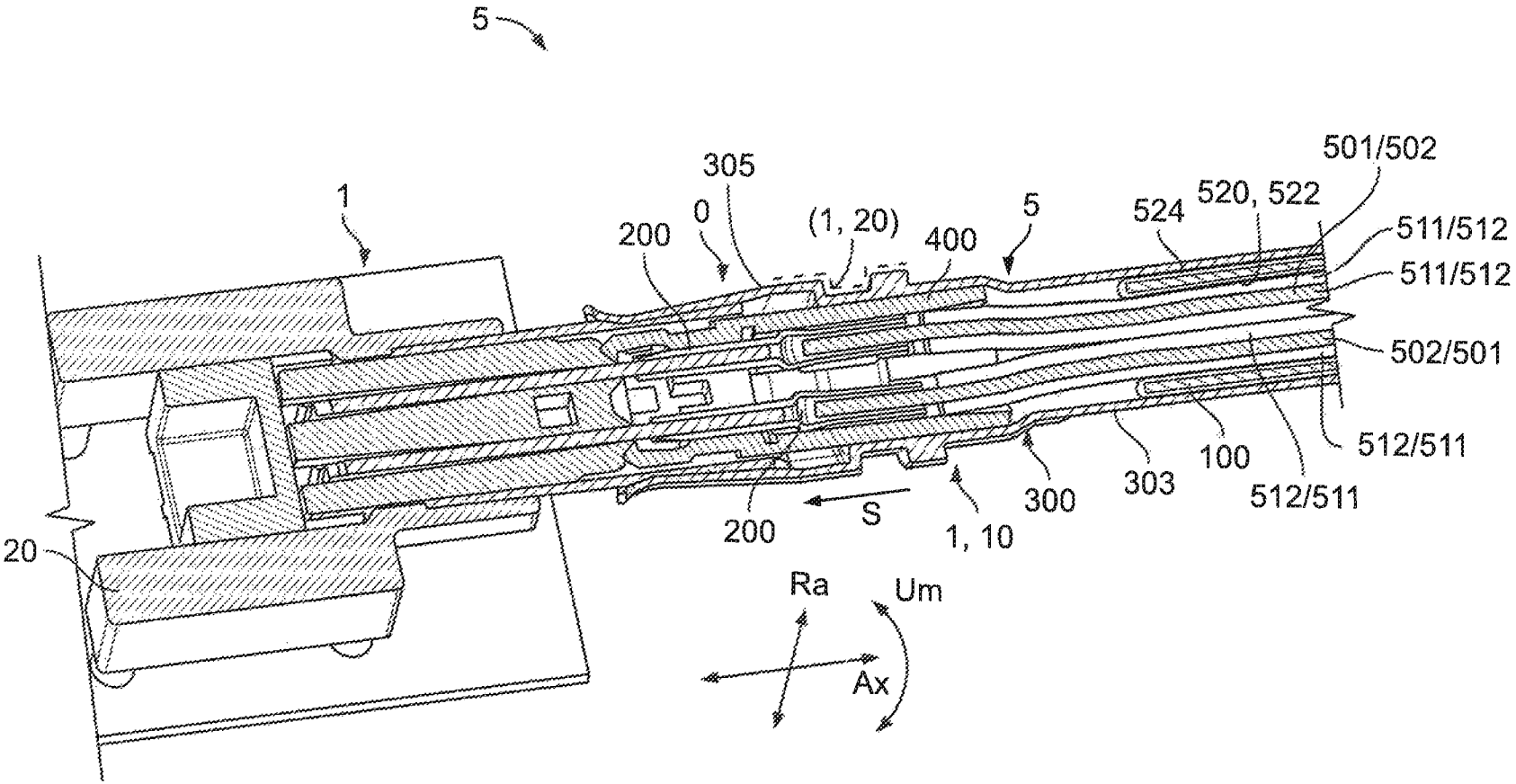
FIG. 11 is a sectional perspective view of an electrical connection between a connector incorporating the assembled twin-axial cable and a counter-connector.

An electrical twin-axial connecting unit 10 having a plurality of electrical contact devices 100, 200, 300 is shown in FIGS. 9-11. In an embodiment, the connecting unit 10 is a mini twin-axial connecting unit 10 and has four electrical contact devices 100, 200, 200, 300 for the automotive industry. The twin-axial connecting unit 10 can be assembled with an electrical twin-axial cable 50.

The concepts disclosed herein can, however, be applied to other connectors, connecting units, contact devices or cables (cable harness) in the automotive industry or outside of the automotive industry, such as in an electronics, electrical engineering or power engineering industry; the invention can be applied, for example, to connecting units, contact devices or cables in the computer and (consumer) electronics industry. Furthermore, the terminology connector and counter-connector, connecting unit and counter-connecting unit, pin-/peg-/tab contact device and socket contact device are intended to be interpreted as synonymous, i.e. optionally interchangeable with one another.

An electrical connector 0, shown in FIG. 11, includes a connector 1 and a counter-connector. The connector 1 includes the connecting unit 10 and a connector housing 20. In another embodiment, the connecting unit 10 can function as the connector 1. In an embodiment, the counter-connector can be formed similarly to the connector 1. According to the FAKRA standard, in particular for a radio frequency ("RF") or high frequency ("HF") plug connection 0, the connector 1 for the twin-axial cable 50 can, for example, be formed as pin-, peg-, tab-, socket-, hybrid plug connector, flying coupling, built in plug, built in socket, plug receptacle, socket receptacle, header, interface, or any other type of connector.

The explanation of the embodiments with reference to the drawings is subsequently related to an axial or longitudinal direction Ax (longitudinal axis Ax, axial plane Ax, also plug-in direction S), a radial direction Ra (radial plane Ra) and a circumferential direction Um (tangent plane Um) of the electrical (plug) connection 0 of the electrical connector 1, of the connector housing 20, of the connecting unit 10, and of the twin-axial cable 50 as shown in FIGS. 10 and 11.

The contact devices 100, 300, as shown in FIGS. 4, 6, 8, and 10, have crimping sections 103, 301, 303. The crimping sections 103, 301, 303, at least in a crimped, closed state on the cable 50, have a geometry or shape which is oval in cross-sections at least in sections. In an embodiment, substantially the entire closed crimping section 103, 301, 303 has an oval geometry or shape in substantially all its cross-sections. In an embodiment, in the crimped state of the contact device 100, 300 and in a radial plane Ra of the crimping section 103, 301, 303, in the circumferential direction of the crimping section 103, 301, 303, the diameters of the crimping section 103, 301, 303 can substantially continuously vary between a comparatively small diameter and a comparatively large diameter.

In an embodiment, the contact device 100 is a ferrule 100 having a ferrule crimping section. In various embodiments, a third contact device 300 can have a single crimping section 301, 303 or can have an insulating crimping section 301 and an outer conductor crimping section 303. The crimping sections 103, 301, 303 can be formed in an open, non-crimped state in sections as a thin oval ring section or even in sections as a thin circular ring section. A cross-section of the entire open crimping section 103, 301, 303 can be u-shaped or v-shaped; the two outer lateral limbs are formed either long or short in comparison with a connecting section of the lateral limbs. An oval cross-section is intended to mean that the cross-section possesses a level, rounded and primarily or substantially completely convex shape, a circular shape and a loop being ruled out. This means that the cross-section is approximately, primarily or substantially formed as two-dimensionally "egg-shaped" or elliptical.

Figure 2:
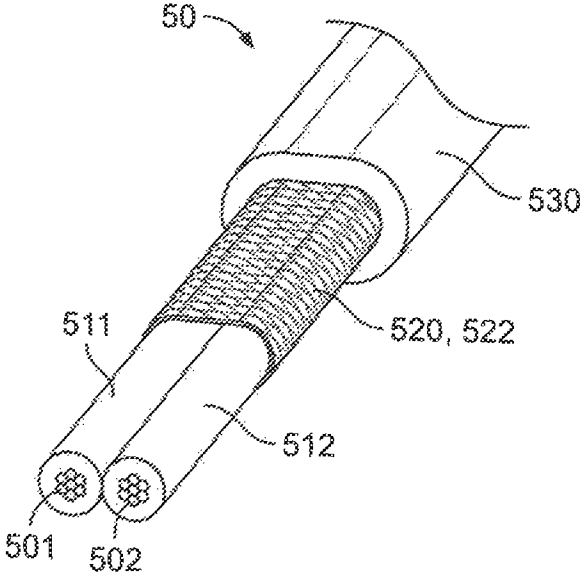
FIG. 2 is a perspective view of a twin-axial cable according to another embodiment with an oval outer geometry and an oval inner geometry of an electromagnetic shield.

The electrical twin-axial cable 50 is shown in FIGS. 1 and 2. The electrical connector unit 10, shown in FIGS. 10 and 11, is crimpable to the cable 50. The twin-axial cable 50 comprises a first electrical inner conductor 501 which is surrounded by a first inner insulation 511 or a first dielectric 511, and a second electrical inner conductor 502 which is surrounded by a second inner insulation 512 or a second dielectric 512. The two inner conductors 501, 502 are installed side-by-side, in particular parallel to one another, in the twin-axial cable 50 and each comprise, for example, a strand or wire made from aluminum or copper.

The two inner insulations 511, 512 are closely surrounded, i.e. with a low tolerance, by an electrically conductive or electrically insulating film 520 and/or an electrical outer conductor 522 as an electro-magnetic shield 522 (e.g. shield conductor 522, braid wire 522, braid line 522), as shown in FIGS. 1 and 2. In an embodiment, the outer conductor 522 is formed from aluminum or copper. An outer insulation 530 of the twin-axial cable 50 is located radially Ra outside the film 520 and/or the outer conductor 522.

As shown in FIGS. 9-11, the connecting unit 10 has the contact devices 100, 200, 300 that include a single ferrule 100, a pair of terminals 200, 200, and a shield contact sleeve 300. Between the two terminals 200, 200 and the shield contact sleeve 300, an electrical insulation 400 or a dielectric 400 is located which can be formed in multiple parts, in one piece, materially in one piece or integrally. It is of course possible to constitute such a connecting unit 10 solely by a single ferrule 100, a single contact device 100/300, or otherwise by one or a plurality of contact devices 100, 200, 300.

Figure 4:
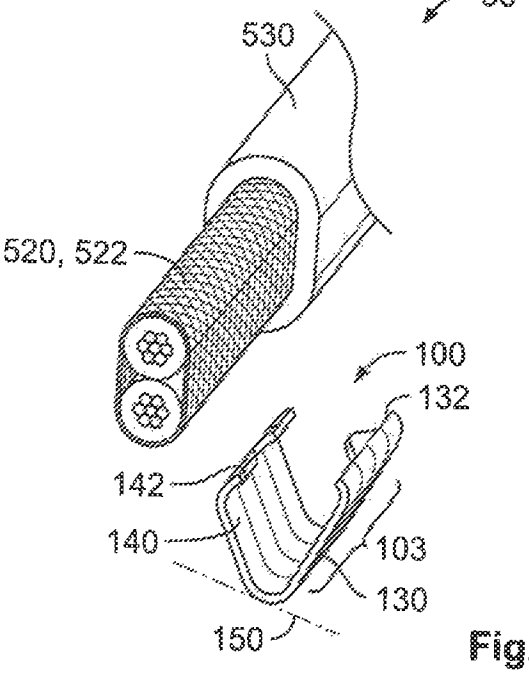
FIG. 4 is a perspective view of the longitudinal end section of the twin-axial cable of FIG. 3 with a ferrule.

The contact device 100 embodied as the ferrule 100, as shown in FIG. 4, is formed as a first electrical twin-axial contact device 100. In this case, the ferrule 100 is formed open or partially closed, for example gaping, in the circumferential direction Um prior to mounting. The ferrule 100 is totally plastically deformable, i.e. crimpable, and is formed in one piece, materially in one piece or integrally. The ferrule 100 can be formed as only one single mounting section in the axial direction Ax. The ferrule 100 can also be described, for example, as a press clamp 100, pressure sleeve 100, clamping ring 100, ring fitting 100 or netting end-sleeve 100, each having a crimp slit 109 as shown in FIG. 10.

The contact device 200 embodied as the terminal 200, as shown in FIG. 11, is formed as a second electrical twin-axial contact device 200. The terminal 200 is partially plastically deformable, i.e. crimpable, and is formed in one piece, materially in one piece or integrally. In an embodiment, the terminal 200 is formed partially as a crimp sleeve. It is of course possible to use a non-crimpable terminal 200 which, for example, can be adhered, soldered, welded, etc. The terminal 200 can be formed as a pin-, peg-, tab-, or socket contact device.

Figures 5, 6, 7, 8:
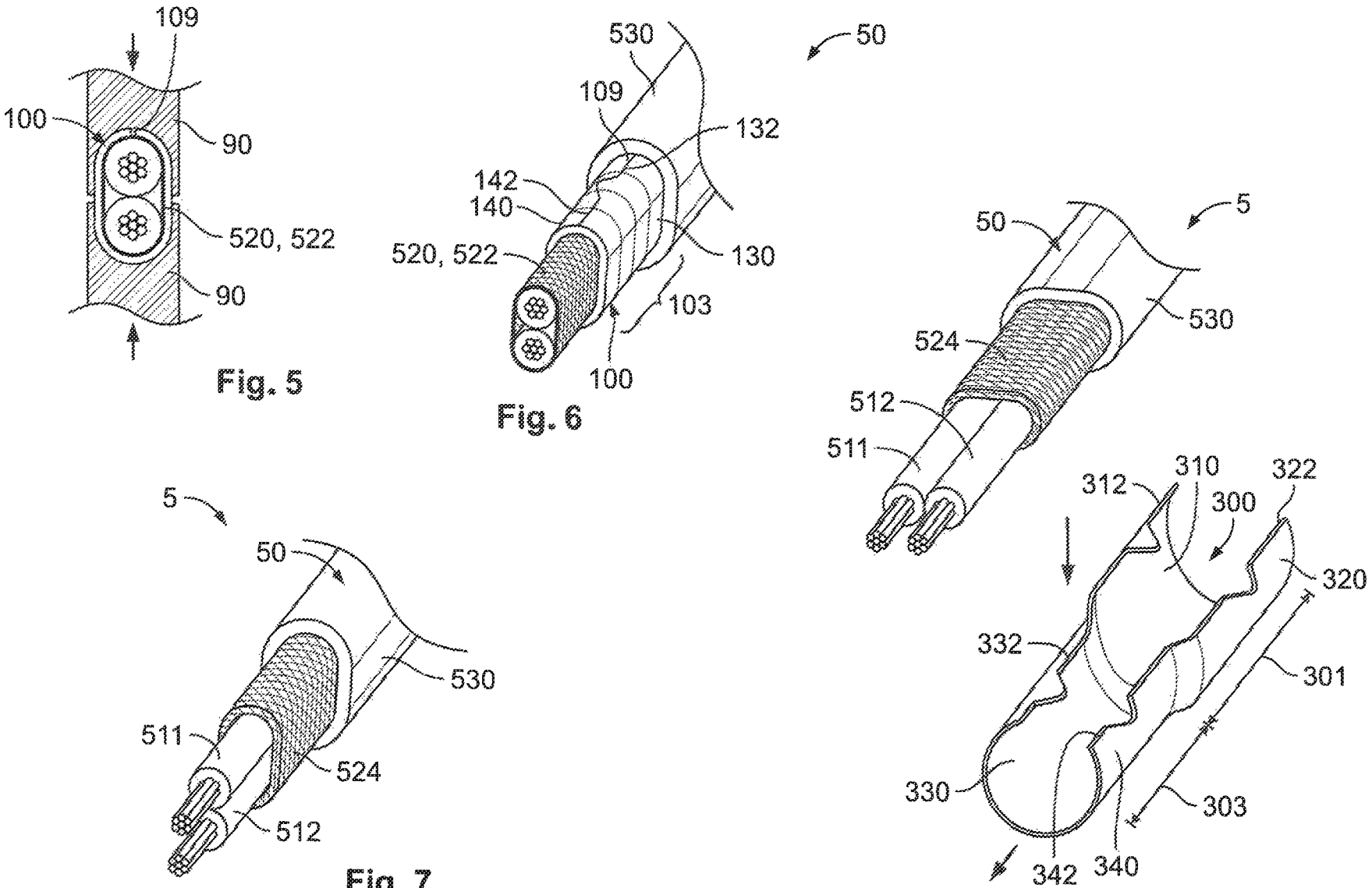
FIG. 5 is a front sectional view of the longitudinal end section of the twin-axial cable with a pair of crimping tools producing a crimp connection between the ferrule and a rear section of the longitudinal end section.
FIG. 6 is a perspective view of the ferrule fixed at the rear section of the longitudinal end section of the twin-axial cable.
FIG. 7 is a perspective view of a remaining free longitudinal end section of an outer conductor of the twin-axial cable moved onto the ferrule and inner conductors of the twin-axial cable protruding therefrom.
FIG. 8 is a perspective view of the twin-axial cable of FIG. 7 with a shield contact sleeve.

The contact device 300 embodied as the shield contact sleeve 300, as shown in FIG. 8, which can also be described as an impedance contact sleeve 300, is formed as a third electrical twin-axial contact device 300. The shield contact sleeve 300 is partially plastically deformable, i.e. crimpable, and is formed in one piece, materially in one piece or integrally. In an embodiment, the shield contact sleeve 300 is formed partially as a crimp sleeve 301, 303. The shield contact sleeve 300 includes an insulating crimping section 301, an outer conductor crimping section 303, and an electrical shield contact section 305 for electrical contact with a shield contact section of a counter-connector.

A construction and a substantially three-stage method for assembling the twin-axial cable 50 with the connecting unit 100 will now be described in greater detail with reference to FIGS. 3-10. FIGS. 3-7 illustrate the first step I of the method which relates to mounting the ferrule 100 with up to four or more substeps (I.1 to I.4), a twin-axial cable 5 described as a pre-assembled twin-axial cable 5 being obtained at the end of the first step I. The second step II and the result thereof, a pre-assembled twin-axial cable 5 with two terminals 200, is shown and described generally with reference to FIG. 11. FIGS. 8 and 9 depict the third step III, with up to two or more substeps III.1, III.2, of the assembly method resulting in a fully assembled twin-axial cable 5.

The first step I of the method will now be described with reference to FIGS. 3-7.

Figure 3:
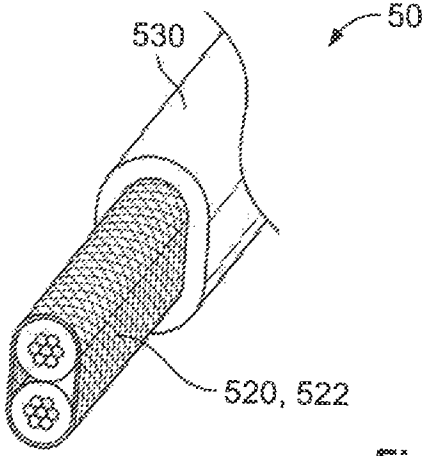
FIG. 3 is a perspective view of a longitudinal end section of the twin-axial cable of FIG. 2.

In the first substep I.1 shown in FIG. 3, the twin-axial cable 50 is freed or stripped from the outer insulation 530 at its free longitudinal end section and thus a longitudinal end section of the outer conductor 522 is exposed.

As shown in FIGS. 4-6, the ferrule 100 is then fastened, in particular crimped in second substep I.2 to a rear section of the free outer conductor 522, the crimped state of the ferrule 100 at/on the twin-axial cable 50 being shown in FIG. 6. The rear section of the free outer conductor 522 is inserted into the ferrule 100, which is located at a carrier strip 150, and, following on chronologically, the ferrule 100 is crimped. The ferrule 100 can then be separated from the carrier strip 150. It is also possible to firstly separate the ferrule 100 from the carrier strip 150, then to move the ferrule 100 onto the rear section of the free outer conductor 522 and then crimp it thereon. A hybrid type is also possible when combining the ferrule 100 with the twin-axial cable 50, the ferrule 100 and the rear section of the free outer conductor 522 moving towards one another.

Prior to its mounting in a circumferential direction Um of the connecting unit 100 or the ferrule 100, the plastically deformable and in particular integral ferrule 100 is formed completely open in the axial direction Ax and has two mounting mechanisms 130, 140 which are formed as crimp flanks 130, 140, as shown in FIG. 4. Each crimp flank 130, 140 has a circumferential edge section 132, 142. The two circumferential edge sections 132, 142 which are related to one another are formed substantially complementary or substantially in a form-fitting manner with one another such that, in the crimped state of the ferrule 100, a crimp slit 109 is formed in a substantially light-tight manner between the crimp flanks 130, 140 of the mounted ferrule 100 in the axial direction Ax of the connecting unit 100 or the ferrule 100, as shown in FIG. 6.

In an embodiment, when plastically deforming the substantially entire ferrule 100, at least one latching unit, in particular a latching projection, can be formed at/in the ferrule 100. Furthermore, alternatively or additionally, when plastically deforming the ferrule 100, at least one other unit, such as a ribbing or another structure, can be installed at/in the ferrule 100. This can result in an improved electrical contact between the ferrule 100 and an end section 524 provided externally on the outer conductor 522 and/or of the shield contact sleeve 300, wherein optionally also an electrically non-conductive ferrule 100 can be used.

The ferrule 100 or the crimp flanks 130, 140 are constituted as a crimping section 103, which is installed at/on the twin-axial cable 50 in the crimped state as a closed and, in substantially all cross-sections, oval crimping section 103 as shown in FIG. 6. FIG. 5 shows the establishment of the crimped state of the ferrule 100 or the crimping section 103 thereof by two crimping tools 90 such as a crimping machine. The crimping section 103 can, already prior to crimping, have an approximately oval cross-sectional geometry or can obtain it only during crimping.

In an optional third substep I.3 shown in FIGS. 6 and 7, the free end section 524 of the outer conductor 522 is moved externally onto the ferrule 100. If the substep 13 is omitted, which is possible, the ferrule 100 is made from an electrically conductive material. In another embodiment, a free end of the outer conductor 522 substantially coincides with a free end of the ferrule 100 in an axial manner Ax.

In a fourth substep I.4, two free longitudinal end sections, which protrude at a free end of the moved end section 524, of the twin-axial cable 50 are stripped at their longitudinal end regions, as shown in FIG. 7. Two longitudinal end sections then protrude at the moved end section 524, which, starting from a free end, first comprise a bare inner conductor 501, 502 and further back the inner conductor 501, 502 provided with an inner insulation 511, 512. In this substep I.4, the inner conductors 501, 502 are freed from the respective inner insulation 511, 512 to such an extent that the terminals 200, 200 can be provided at the inner conductors 501, 502 and an expansion of a gap between the inner conductors 501, 502 can take place in the connecting unit 10.

In the second step II, the terminals 200, 200, in this case formed as socket contact units 200, 200 as shown in FIG. 11, are provided at the inner conductors 501, 502. At the end of the second step II, a pre-assembled twin-axial cable 5 is obtained which can also be described as a subassembly, having the twin-axial cable 50 with the ferrule 100 and the terminals 200, 200.

The elongated and in particular integrally configured terminals 200, 200 each have a mounting section, for example a crimping section, at a rear end section. At a front end section, each terminal 200, 200 has an electrical contact section which in this case is designed as a socket contact section. A pin-, peg-, tab contact section, etc. can of course be used. In addition, the respective terminal 200, 200 can have a transition section between the crimping section and the contact section. Moreover, the respective terminal 200, 200 can have a latching unit in the transition section for locking the respective terminal 200, 200 in place.

In the second step II, a respective terminal 200, 200 is first separated from a carrier strip for terminals. Subsequently, the respective crimping section is moved to the related free longitudinal end region of a related inner conductor 501, 502 with the related longitudinal end region of the related inner conductor 501, 502 resting in a foundation of the respective crimping section. The respective crimping section is then crimped to the related inner conductor 501, 502. In an embodiment, this can occur in reverse; crimping the respective crimping section to the related inner conductor 501, 502 with the respective terminal 200, 200 still located at the carrier strip; a pre-assembled twin-axial cable 5 which results therefrom is only then separated from the carrier strip. Instead of a crimping method, a different method can, of course, also be applied, the respective terminal 200, 200 then being configured in a correspondingly different manner such as an adhesive-, soldering-, or welding section instead of a crimping section.

The third step III of the method is shown in FIG. 8-10 with the pre-assembled twin-axial cable from FIG. 7 being further assembled. As a result of the third step III, a fully assembled twin-axial cable 5 is obtained, having the twin-axial cable 50 with the ferrule 100, the terminals 200, 200 and the shield contact sleeve 300. The fully assembled twin-axial cable 5, comprising or having an electrical connector 1, can be installed such that it can be plugged onto a counter-connector 1 shown in FIG. 11 without further action. Alternatively, the connector 1 of the fully assembled twin-axial cable 5 can be primarily and optionally additionally secondarily latched in a connector housing 20 shown in FIG. 11.

The third step III of the assembly method relates to mounting the shield contact sleeve 300. The elongated and in particular integrally configured shield contact sleeve 300 in this case is formed as a crimp sleeve 300. At a rear end section, the shield contact sleeve 300 has a mounting section 301, in particular an insulating crimping section 301, with two mounting mechanisms 310, 320 which are opposite one another and which are formed as insulating crimp flanks 310, 320. The insulating crimp flanks 310, 320 can be formed open, gaping, curved and/or pre-rolled. Furthermore, the insulating crimp flanks 310, 320 can be curved or pre-rolled within the scope of the third step III.

At a front end section, the shield contact sleeve 300 has a shield contact section 305 shown in FIG. 11 for electrically contacting the counter-connector. Between the insulating crimping section 301 and the shield contact section 305, the shield contact sleeve 300 has a mounting section 303, in particular an outer conductor crimping section 303, with two mounting mechanisms 310, 320 which are opposite one another and which are formed as conductor crimp flanks 330, 340. The conductor crimp flanks 330, 340 can be formed open, gaping, curved and/or pre-rolled. The conductor crimp flanks 330, 340 of the outer conductor crimping section 303 transition into the insulating crimp flanks 310, 320 of the insulating crimping section 301 or vice versa.

In an embodiment, only the insulating crimping section 301 and the outer conductor crimping section 303 of the shield contact sleeve 300 are at least partially plastically deformable. In such an embodiment, only four crimp flanks 310, 320, 330, 340 are provided. Each crimp flank 310, 320, 330, 340 has a circumferential edge section 312, 322, 332, 342, wherein circumferential edge sections 312, 322; 332, 342 which are related to one another are formed in a substantially complementary or substantially form-fitting manner with one another such that a crimp slit 309 can be formed in a substantially light-tight manner between the crimp flanks 310, 320, 330, 340 of the mounted shield contact sleeve 300 in the axial direction Ax of the shield contact sleeve 300, as shown in FIG. 9. The shield contact sleeve 300 is formed such that a beginning of the crimp slit 309 can already be visible in a non-crimped shield contact sleeve 300 and does not arise only during crimping.

In an embodiment, in a crimped state of the connecting unit 10, the crimp slits 109, 309 of two contact devices 100, 300 of the connecting unit 10 can be arranged offset from one another in the circumferential direction of the connecting unit 10. In various embodiments, the angle of offset may be approximately 90°, approximately 270°, approximately 180°, or other angles of course may alternatively be applied. The crimp slits 109, 309 of two contact devices 100, 300 of the connecting unit 10 can be arranged substantially without overlap in the radial direction of the connecting unit 10.

In an embodiment, the shield contact sleeve 300 has a transition section between the shield contact section 305 and the outer conductor crimping section 303, which is configured sleeve-shaped. Moreover, the shield contact sleeve 300 can have a latching unit, in particular in its outer conductor crimping section 303, for locking the ferrule 100 in place. In another embodiment, a dielectric 400 can be provided or installed inside the shield contact sleeve 300. The dielectric 400 serves for electrical insulation of the shield contact sleeve 300 relative to the terminals 200, 200 and for bearing and/or centering the terminals 200, 200 in the shield contact sleeve 300 and thus in the connecting unit 10.

In a first substep III.1, a shield contact sleeve 300 with originally formed, pre-curved and/or pre-rolled crimp flanks 310, 320, 330, 340 and a pre-assembled twin-axial cable 5 obtained from the second step II or the subassembly are paired, wherein the shield contact sleeve 300 can remain at a carrier strip for second contact devices 300. If crimp flanks are pre-curved or pre-rolled, only the insulating crimp flanks 310, 320 are pre-curved or pre-rolled; a related free pre-assembled longitudinal end section of the twin-axial cable 50 is moved from behind into the related shield contact sleeve 300.

In a subsequent second substep III.2, the crimp flanks 310, 320, 330, 340 are completely closed and crimped in a crimping machine with the ferrule 100 being able to latch with the shield contact sleeve 300. In this case, the crimping section 301, 303 locks the shield contact sleeve 300 in place, both on the twin-axial cable 50 or the outer insulation 530 thereof and on/over the ferrule 100 or on the moved end section 524 of the outer conductor 522. The shield contact sleeve 300 can now be removed from the carrier strip. It is, of course, possible to first remove the shield contact sleeve 300 from the carrier strip, then pair it with the pre-assembled twin-axial cable 5 or the subassembly and then perform the crimping.

The shield contact sleeve 300 is partially constituted as a crimping section 301, 303 or has two crimping sections 301, 303, which are installed at/on the twin-axial cable 50 in the crimped state shown in FIGS. 9 and 10 as closed and, in substantially all cross-sections, oval crimping sections 301, 303. In this case, the insulating crimping section 301 has larger diameters than the outer conductor crimping section 303. The respective crimping section 301, 303 can, already prior to crimping, have an approximately oval cross-sectional geometry or can only obtain it during crimping. If the twin-axial cable 50 according to FIG. 1 is used, the insulating crimping section 301 in the crimped state thus possesses a circular geometry in substantially all cross-sections.

Figure 12:
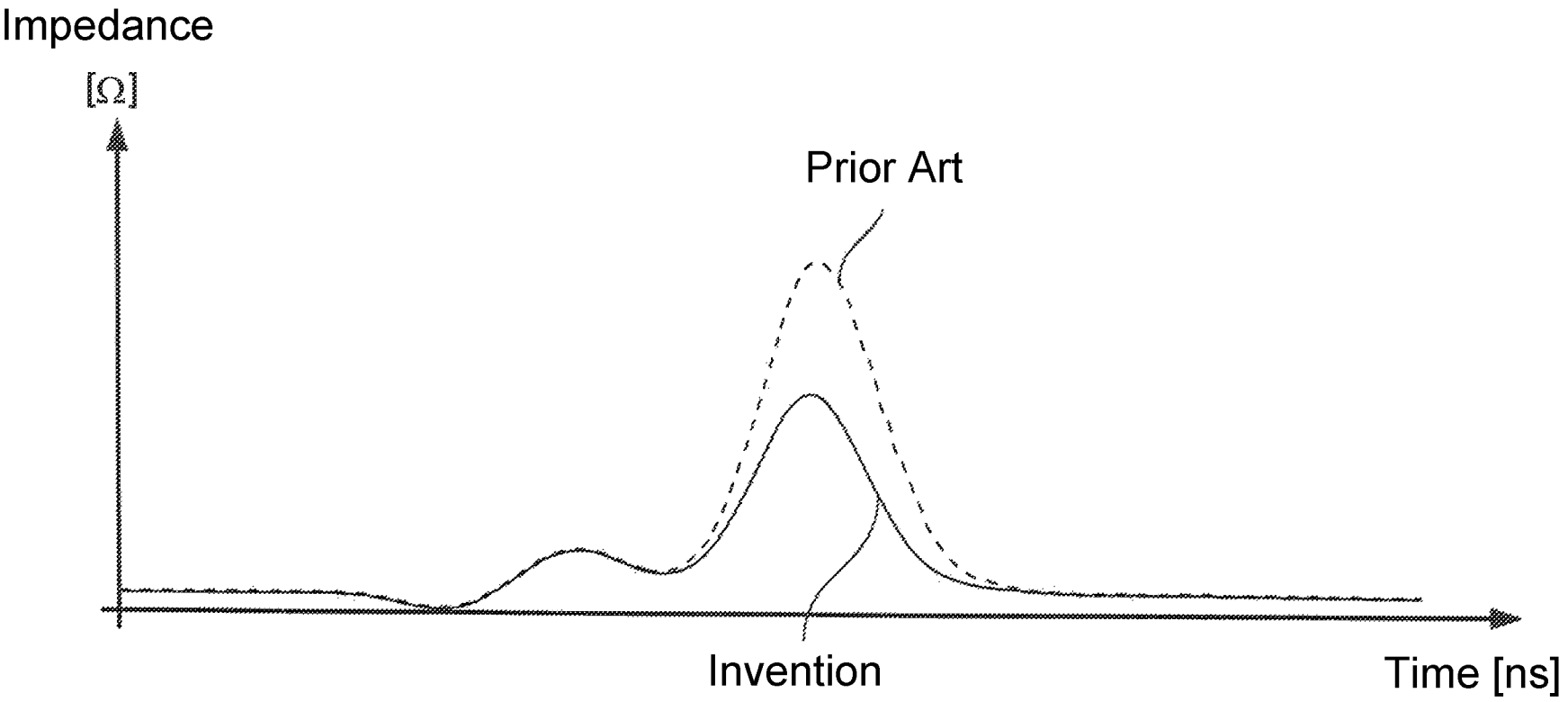
FIG. 12 is a diagram of impedance profiles of prior art and inventive electrical plug connections.

The connecting unit 10 enables a transition from oval to circular and optionally back to oval to be completely avoided and therefore improves a frequency performance of the connector 1 by a significant amount, as shown in FIG. 12. It is further advantageous that an installation space for the connecting unit 10, the connector housing 20, the connector and thus for the electrical connection 0 can be reduced.

What is claimed is:

1. An electrical contact device for a twin-axial electrical cable, comprising:

a crimping section that, in a crimped state on the twin-axial electrical cable, is closed and has an oval cross-sectional shape in at least a portion of the crimping section, an entirety of a longitudinal extension of the crimping section is disposed along the twin-axial electrical cable.

2. The electrical contact device of claim 1, wherein, in the crimped state and in a radial plane of the crimping section, a diameter of the crimping section in a circumferential direction of the crimping section continuously varies along the crimping section.

3. The electrical contact device of claim 1, wherein a plurality of circumferential edge sections of the crimping section are formed in a substantially complementary or substantially form-fitting manner relative to one another;

the crimping section is formed by a single curved wall;

a pair of crimp flanks of the crimping section are formed substantially closed; and/or in the crimped state, a crimp slit is formed in a substantially light-tight manner between the crimp flanks along an axial direction of the contact device.

4. The electrical contact device of claim 1, wherein the contact device is a ferrule substantially constituted as a single crimping section.

5. The electrical contact device of claim 4, wherein the crimping section, in the crimped state, is closed and has the oval cross-sectional shape in all portions of the crimping section;

a longitudinal extension of the ferrule is disposed along an axial direction of the twin-axial electrical cable;

the ferrule has a constant inner diameter in the crimped state in an axial plane; and/or the ferrule is formed as a single crimp flank.

6. The electrical contact device of claim 1, wherein the contact device is a shield contact sleeve having an insulating crimping section, an outer conductor crimping section, and/or a shield contact section.

7. The electrical contact device of claim 6, wherein in the crimped state, the insulating crimping section and/or the outer conductor crimping section installed on the twin-axial electrical cable are closed and have the oval cross-sectional shape in all portions of the crimping sections;

the outer conductor crimping section has the oval cross-sectional shape in all portions of the outer conductor crimping section;

a crimp slit of the shield contact sleeve extends through the outer conductor crimping section; and/or in an open state, the insulating crimping section is formed as a single gaping insulating crimping section and/or the outer conductor crimping section is formed as a single gaping outer conductor crimping section.

8. An electrical connecting unit for a twin-axial electrical cable, comprising:

an electrical contact device having a crimping section that, in a crimped state on the twin-axial electrical cable, is closed and has an oval cross-sectional shape in at least a portion of the crimping section, the electrical contact device is a ferrule and a shield contact sleeve disposed over the ferrule.

9. The electrical connecting unit of claim 8, wherein, in a crimped state:

a crimp slit of the ferrule and a crimp slit of the shield contact sleeve are offset from one another in a circumferential direction of the connecting unit; and/or the crimp slit of the ferrule and the crimp slit of the shield contact sleeve are arranged substantially without overlap in a radial direction of the connecting unit.

10. An electrical connector for a twin-axial electrical cable, comprising:

a connector housing; and an electrical contact device having a crimping section that, in a crimped state on the twin-axial electrical cable, is closed and has an oval cross-sectional shape in at least a portion of the crimping section, the electrical contact device includes a ferrule and a shield contact sleeve disposed over the ferrule.

11. A method for assembling a twin-axial electrical cable, comprising:

crimping an open crimping section of an electrical contact device into a closed crimping section onto the twin-axial electrical cable, the closed crimping section having an oval cross-sectional shape at least in a portion of the crimping section, the electrical contact device includes a ferrule and a shield contact sleeve crimped over the ferrule.

12. The method of claim 11, wherein the ferrule has the oval cross-sectional shape and is crimped on an electrical outer conductor of the twin-axial electrical cable.

13. The method of claim 12, further comprising, after fixing the ferrule, fixing a terminal on an electrical inner conductor of the twin-axial electrical cable.

14. The method of claim 13, further comprising, after fixing the terminal, fixing the shield contact sleeve on the twin-axial electrical cable, an insulating crimping section of the shield contact sleeve having the oval cross-sectional shape in all portions of the insulating crimping section and/or an outer conductor crimping section of the shield contact sleeve having the oval cross-sectional shape in all portions of the outer conductor crimping section.

15. The method of claim 14, wherein, in a crimped state, a crimp slit of the ferrule and a crimp slit of the outer conductor crimping section are offset from one another in a circumferential direction of the connecting unit.

16. An assembled twin-axial electrical cable, comprising:

a twin-axial electrical cable; and an electrical connecting unit at least partially joined to the twin-axial electrical cable, the electrical connecting unit including a ferrule with an oval cross-sectional shape fixedly connected to an electrical outer conductor of the twin-axial electrical cable and a shield contact sleeve disposed over the ferrule and having a crimping section with an oval cross-sectional shape fixedly connected to the twin-axial electrical cable.

* * * * *